US006679178B2

(12) United States Patent
Mihaylov et al.

(10) Patent No.: US 6,679,178 B2
(45) Date of Patent: Jan. 20, 2004

(54) SMOOTH BORE BARREL SYSTEM WITH SELF SPINNING AMMUNITION

(76) Inventors: Gueorgui M. Mihaylov, 1745 Lake Christopher Dr., Virginia Beach, VA (US) 23464; Evdokia K. Mihaylova, 1745 Lake Christopher Dr., Virginia Beach, VA (US) 23464

( * ) Notice: Subject to any disclaimer, the term of this patent is extended or adjusted under 35 U.S.C. 154(b) by 0 days.

(21) Appl. No.: 10/023,260

(22) Filed: Dec. 15, 2001

(65) Prior Publication Data

US 2002/0134273 A1 Sep. 26, 2002

Related U.S. Application Data

(60) Provisional application No. 60/257,866, filed on Dec. 21, 2000.

(51) Int. Cl.[7] ..... F42B 12/00
(52) U.S. Cl. ..... 102/439
(58) Field of Search ..... 102/431, 432, 102/433, 434, 436, 439, 440, 441, 464, 467, 469, 502, 511, 522, 523, 526; 89/14.7, 16; 42/76.02

(56) References Cited

U.S. PATENT DOCUMENTS

| | | | | | |
|---|---|---|---|---|---|
| 3,062,145 | A | * | 11/1962 | Morgan et al. | 102/436 |
| 3,356,029 | A | * | 12/1967 | Seidel | 102/511 |
| 4,063,511 | A | * | 12/1977 | Bullard | 102/436 |
| 4,413,564 | A | * | 11/1983 | Brown | 102/501 |
| 4,858,534 | A | * | 8/1989 | Wallace | 102/511 |
| 4,881,466 | A | * | 11/1989 | McGinley | 102/522 |
| 4,911,079 | A | * | 3/1990 | Sauvestre | 102/439 |
| 4,977,834 | A | * | 12/1990 | Denis | 102/439 |
| 5,062,974 | A | * | 11/1991 | Van Meter | 508/167 |
| 5,164,538 | A | * | 11/1992 | McClain III | 102/517 |
| 5,259,288 | A | * | 11/1993 | Vatsvog | 86/10 |
| 5,341,719 | A | * | 8/1994 | Bullis et al. | 89/16 |
| 5,915,937 | A | * | 6/1999 | Christensen | 42/76.02 |
| 6,158,348 | A | * | 12/2000 | Campoli | 102/443 |
| 6,209,459 | B1 | * | 4/2001 | Kaufman et al. | 102/439 |
| 6,253,682 | B1 | * | 7/2001 | Saxby | 102/444 |
| 6,415,718 | B1 | * | 7/2002 | Saxby | 102/446 |

FOREIGN PATENT DOCUMENTS

| | | | |
|---|---|---|---|
| DE | 4137315 | * | 5/1993 |

* cited by examiner

*Primary Examiner*—Peter M. Poon
*Assistant Examiner*—David Parsley

(57) ABSTRACT

A smooth bore barrel system utilizes an ammunition round capable to provide the projectile, covered with predetermined usually spiral grooves (44) and lands (42) congruently engaged in the rifled by the same manner inner surface (30A) of the cartridge case (30). When fired the rifled cartridge case serves as a short disposable rifled barrel spinning the projectile. A front short non-rifled part (40B) of the cylindrical portion of the projectile is extended into the smooth bore barrel (20) having sliding fit within. Alternatively, spinning momentum is provided by having the grooves tapering to narrow channels extended through the short cylindrical portion of the projectile forming jets (48), which rotate the projectile by jet propulsion forces. Spinning momentum is gained by two independent approaches which effect could be combined or used separately.

11 Claims, 7 Drawing Sheets

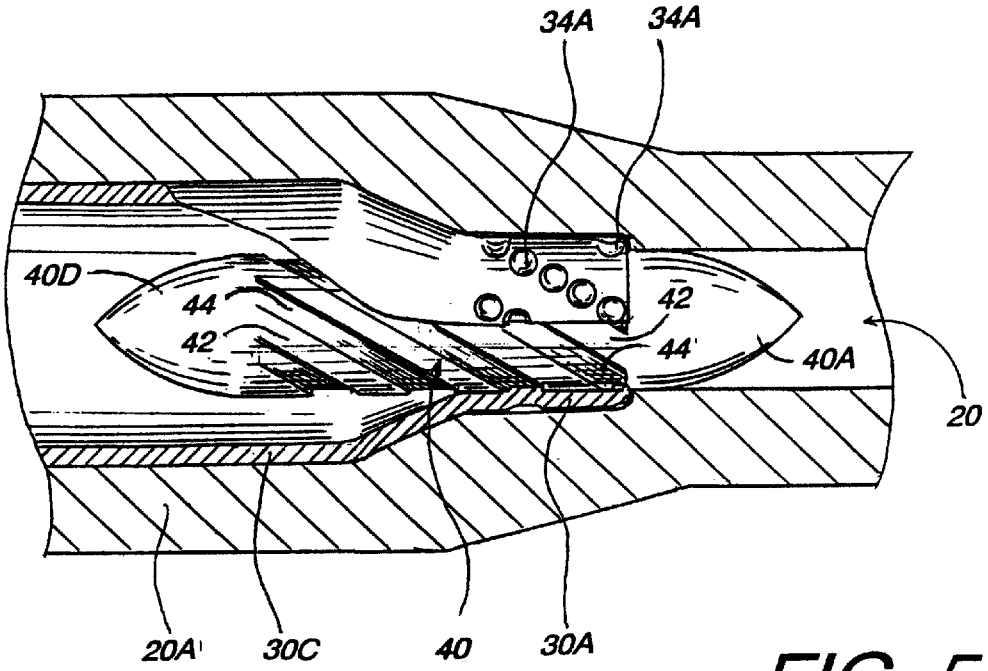
FIG. 5
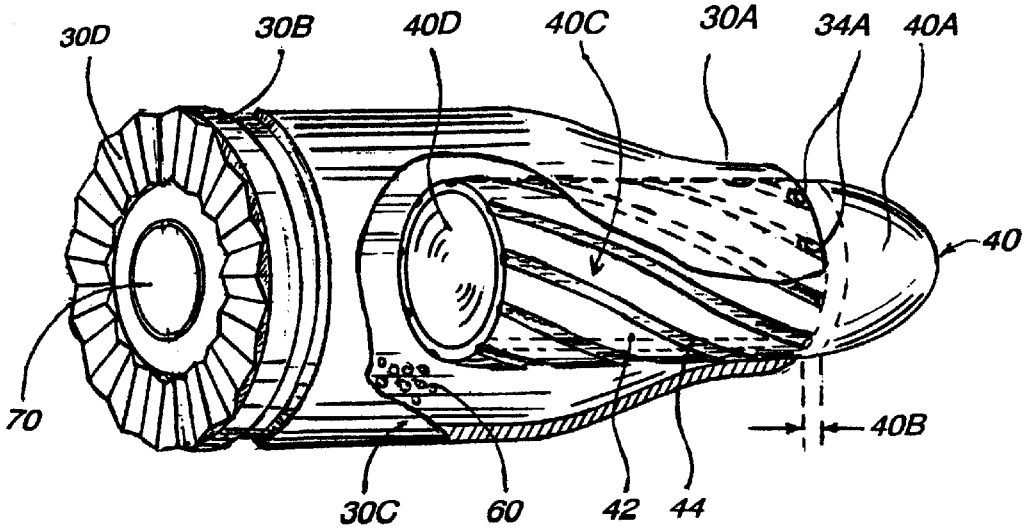
FIG. 5-A

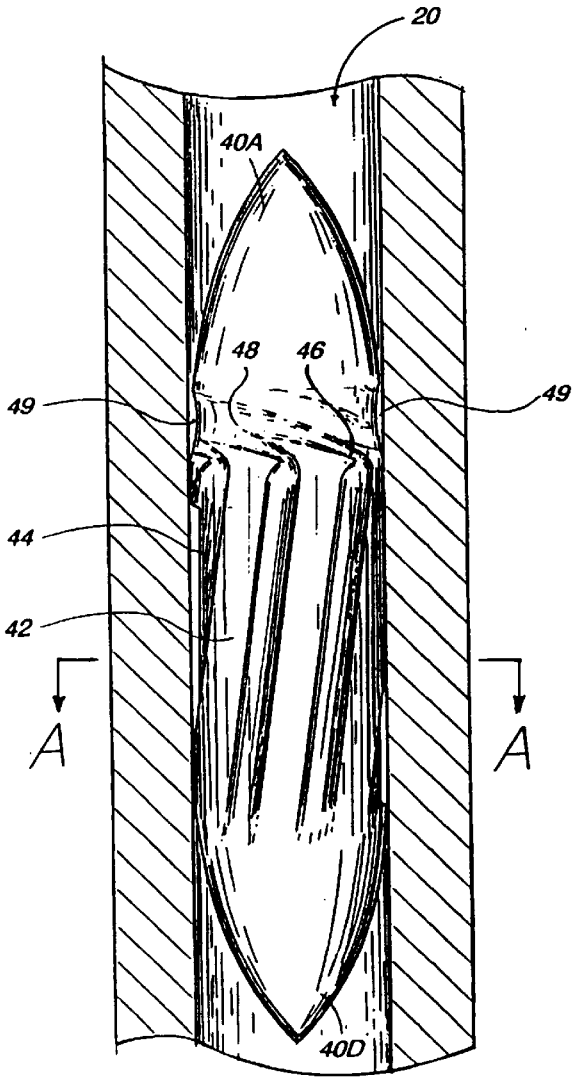
FIG. 6
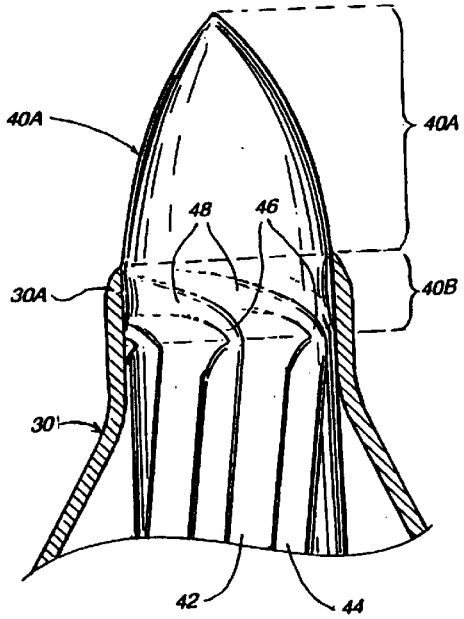
FIG. 6-A
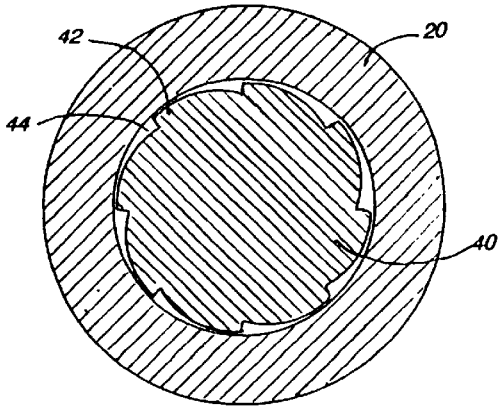
FIG. 6-B

SMOOTH BORE BARREL SYSTEM WITH SELF SPINNING AMMUNITION

Priority is claimed under 35 U.S.C.119 (e) To provisional patent application Ser. No. 60/257,866, filed Dec. 21, 2000.

BACKGROUND OF INVENTION

1. Field of Invention

This invention relates to firearm systems having a barrel and particularly to smooth bore barrel system and ammunition that is achieving stability in flight by spinning the projectile.

2. Description of the Prior Art

The predominant group of the breech loaded contemporary weapons has helical rifled barrels. The purpose of rifling is, by having a close fit, to spin the projectile along the barrel and to give the projectile stability during the exterior ballistic, provided by gyroscopic effect. The rotation is around the main axis of the projectile and the barrel. Low rotation speed leads to less stability, very high rotation speed leads to, so called "nose up"-effect, otherwise the axis of the projectile crosses trajectory of exterior ballistic. Therefore the pitch of the rifling has to be carefully considered upon the range and the purpose of the projectile. The conventional projectile has a part of its surface (or jacket) that is slightly oversize or interference fit with regard to the bore diameter of the barrel of the weapon with which it is used. The surface (jacket) of the projectile is getting squeezed and engraved during the passage down the barrel of the weapon by the helical rifling grooves in the barrel. The projectile is spun by the rifling grooves to stabilize its flight as explained hereinafter. Considerable portion of the energy produced by the propellant is lost by the process of squeezing and engraving and by the dry friction between the projectile and rifled barrel along the acceleration. Engraving and friction not only consume the energy of the propellant but also transfer the kinetic energy once gained by hot propellant gases, again to heat. The friction and heat are serious problems especially for automatic or high caliber weapons, causing fast barrel erosion and loss of external ballistic properties—range and accuracy. Thermal enlargement of the bore barrel also leads to uncontrolled loss of pressure fit and less muzzle velocity affecting the same way exterior ballistic properties.

In order to reduce the negative effects of engraving and friction, several different approaches are established as state-of-the-art. Wide spread approach to reduce the dry friction is to put the projectile into a plastic cylindrical body (sabot) engaged with the projectile surface until both leave the muzzle thereby using friction plastic/metal instead of metal/metal and reducing the friction. Many patents used this approach so the patents cited herein: U.S. Pat. No. 3,847,082 issued to Feldmann F.; U.S. Pat. No. 3,769,912 to Friend W. H.; U.S. Pat. No. 4,063,511 to Bisping B. and they are cited here only as representative examples. A large variety of patents exploit similar approaches. Common and overwhelming drawbacks of introducing a sabot is the use of soft material preferably plastic, which decreases very fast its mechanical properties with increase of working temperature (especially in automatic weapons) and leads literally to smear the surface of the sabot along the barrel. Another disadvantage relates to the energy used to accelerate the sabot, which is not part of the projectile in flight, therefore the heavier the sabot—the bigger the loss of energy. One more disadvantage is that the projectile is always subcaliber compared to the full bore diameter with proportional reduction of the load.

Another approach is to use completely smooth bore barrel and a different means of providing the projectile with revolving momentum. One of them—U.S. Pat. No. 4,386,747 to Kuhl R. D. is using ammunition with means for self-generated revolving momentum.

A toroidal mass is disposed inside the projectile and attached and secured to the projectile by means of bi-convex spring or similar flexible structure so that the mass is setoff in oscillation upon the sudden acceleration due to the firing of the projectile. There are several drawbacks of this solution: the system is usable only for comparably big caliber weapon; a sufficient part of the weight and free volume of the projectile is used to accommodate the structure of toroidal mass, and bi-convex spring; an important part of the mass and volume of the projectile is engaged to provide revolving momentum; the relative density of the projectile is reduced.

Another direction is using only the smooth bore barrel to provide the conventional projectile with revolving momentum as in U.S. Pat. No. 4,841,657 to Mossberg A. I. The system is using axially rotating barrel moved by the force of expanded gases. The axially rotating barrel is engaged with the projectile surface whereby to impart rotary motion to the projectile. This system has to respond to controversial requirements. In order to provide revolving momentum to the projectile the barrel has to have a good grip with it. This defeats one of the main purposes of the smooth gun barrel—reducing the friction and friction-related erosion The increased grip will lead to increase of the temperature and thermal enlargement of the barrel. An enlarged barrel cannot provide a good grip thereby cannot provide a repeatable revolving momentum and will lead to significant lost of gas pressure.

Another disadvantage is that a big part of the propellant energy will be consumed for moving comparably big mass of the barrel, back, forward and around the axis with appropriate velocity. U.S. Pat. No. 4,176,487 issued to Manis J. R. teaches a system comprising a smooth bore barrel with annular grooves or pockets in the bore-walls which act as propellant gas pressure relief areas. When the projectile is fired, the helical notches on its rear part interact with the gas pressure relief areas or spaces of the bore, allowing the propellant gas to be expanded through the rear helical notches imparting a twist to the projectile. The system uses mutual interaction between specially designed bore barrel (referred as smooth bore barrel, despite a number of annular chambers along the barrel) and ammunition with rear helical notches. The drawback of this system is that the stress-point of each annular chamber reduces significantly the mechanical properties of the barrel. The difficulties of manufacturing and especially of cleaning such barrel from the products of propellant burning are another disadvantage. When in flight the helical notches will interact with air, imparting to the projectile an inverse directed twisting motion, therefore reducing the initial revolving momentum and abating the external ballistic properties.

There are two different parts of the barrel largely exposed to erosion. First one is breech part neighboring the cartridge nest, where the action of high temperature and high-pressure gases is combined with the process of engraving the projectile and dry friction. The second one is, before and at the muzzle, where the dry friction is combined with highest velocity of the projectile.

A very early notion of minimizing the erosion from the burning propellant and engraving is carried in the U.S. Pat. No. 37,193 to Alsop C. R. The patent suggests attaching a rifled section to the muzzle of smooth bore barrel thereby gaining a high speed and decreasing the erosion of hot gases at the breech section. The rifled section is engraving the projectile and giving to it revolving momentum. The patent admits that the rifling is imparting a considerable friction and transmitting substantial heat to the projectile, but those problems are said to be overcome by gained momentum of the projectile. The rifled section was suggested as a gradual reduction in diameter of the bore progressing away from the breech and into the rifled section. The length of the rifled section is proposed to be 2 to 3 inches. The rifled section has to be mounted to the main barrel by threaded connection with thread direction opposite to the rifling.

Despite the drawbacks of this concept, it was revitaized recently in U.S. Pat. No. H0001365 to Amspacker M. R. The concept reduces unacceptable erosion of the breech section. The gun barrel comprises a smooth bore breech section and a longer gain twist rifled muzzle section. The smooth bore breech section is said to be always less than one-fifth the total length of the gun barrel. The system claims to be accurate but the problem with erosion of the muzzle section seems to be even aggravated by higher speed of the projectile and the pitch of the rifling which increases from its beginning to the muzzle end.

It is known system utilizing a smooth bore barrel fitted with a short rifled insert near the breech (U.S. Pat. No. 4,712,465 to Macdonald Kenneth A. B.). A projectile comprising perforated skirt and driving band about the base of the skirt is loaded into the gun barrel so that the driving band just engages the rifled insert and the warhead portion of the projectile extends into the smooth bore portion of the barrel. Upon firing of a breech charge, gases from the breech charge are ducted to the space between the thin sidewalls of the projectile and the smooth central bore, thereby establishing a gas bearing. The gas from the bearing provides lateral support to the projectile and lubricates the projectile. Drawbacks of that system are the presence of the driving band, which has to be durable enough to be engraved and to transfer the rotation impulse to the projectile. Same driving band has to be soft enough to get squeezed into specially formed annular groove thereby to form a cylindrical body with the entire projectile. Again part of the propellant energy is consumed to engrave and to fabricate in-situ with all heat related consequences. The system is designed to spin comparably big caliber projectiles or fin stabilized rockets.

Another system using combination of a rifled bore section at the breech and a smooth bore section at the muzzle end is proposed in U.S. Pat. No. 4,660,312 to A'Costa A. The diameter of the smooth bore section is greater than the diameter of the bore of the rifled bore section and smaller than the diameter of the spiral-rifled groove. The system therefore is vulnerable to have gas pressure losses along the grooves of the projectile during the acceleration or to have a spin momentum losses in the smooth bore section because the fit is too tight. The system proposes a way to decrease those drawbacks by having a compromised smooth bore diameter. The friction thereof is still a persisting problem, but instead of engraving grooves, the smooth bore is squeezing the projectile to get better gas fit. This fact can lead to big, if not to entire, lost of revolving momentum.

It will readily be appreciated by those skilled in the art, that none of the approaches used herein is providing a complete solution of the problems associated with rifled bore barrel Some solutions are more or less applicable to a certain class and caliber systems, and only few of them correspond to the requirements of automatic firing weapons.

Objectives and Advantages

General objective of the present invention is to overcome the drawbacks of the prior art discussed heretofore. Dry friction and heat generation along the barrel will be reduced drastically thereby reducing the erosion in the breech part and the muzzle part of the bore, which are more vulnerable to wearing.

Another objective of the present invention is to reduce the amount of propellant used to give appropriate impulse and velocity to the projectile. Proportionally will be reduced the revolving impulse stabilizing the projectile in fight. This objective is aiming to reduce the weight of the ammunition needed for the same mission.

Consecutively another objective of the present invention is to allow achievement of substantially higher muzzle velocity therefore substantially higher range of fire.

Another objective of the present invention is to increase the mass fraction ratio between ordnance payload mass to structural mass of the projectile thereby increasing the effectiveness of the bigger caliber projectile.

SUMMARY OF THE INVENTION

The present invention uses two different aspects in combination or solely to achieve the set objectives heretofore. According to the first aspect of the present invention the firearm encompasses a smooth bore barrel having a nest for the cartridge in the breech part. This nest contains the cartridge having its front section facing the muzzle and having inner diameter substantially the same as the diameter of the bore of the barrel. This section of the cartridge has a rifled inner surface with grooves and lends representing itself a short rifled barrel As the cartridge case is assumed to be disposable this rifled section could be referred also as disposable rifled barrel. The diameter of the grooved part of the cartridge is substantially the same and slightly smaller than the diameter of the smooth bore. The diameter determined by the lands is smaller with a fraction representing twice the depth of the grooves. The ratio between the two diameters is substantially the same as this in the rifled bore barrel of the same caliber. The pitch of the helically-rifled section is substantially higher than the regular one of same caliber conventional barrel In this rifled section of the cartridge is engaged relatively long portion (up to 98%) of the cylindrical part of the projectile. This engaged cylindrical portion has outer surface with grooves and lands congruently matching those of the rifled section of the cartridge. A thin layer of dry or paste with small coefficient of friction, based on graphite or molybdenum sulfide, is used to hermetically seal the projectile into the cartridge. A non-rifled cylindrical portion of the projectile, representing 2 to 10% of the cylindrical length, but not limited to this range, is extended from the front end of the cartridge into the basic smooth bore barrel This non-rifled cylindrical portion taper with smooth transition to streamline ogival front part of the projectile. The non-rifled portion has a sliding plunger fit to the bore surface. The rear part of the projectile facing the breech has preferably ogival shape thereby to provide the projectile with better fairing shape.

In particular case explained hereinafter, rifled grooves could be parallel to the axis of the projectile, therefore no pitch is applied to the grooved (rifled) surface.

According to the first aspect of the present invention there are two distinguishable phases of the interior ballistic. First of those phases includes the moment of ignition and initial move of the projectile along the short rifled barrel section of the cartridge. The second phase starts when the projectile leaves the rifled section and moves down the barrel. When the propellant is ignited, the hot gases start to expand and develop an axial force. This axial force moves forward the projectile when the helically engaged grooves revolve the projectile providing a spin enough to keep the stability by gyroscopic effect along the acceleration in the barrel to the muzzle and further during the exterior ballistic. The expanding gases act on the entire rear surface of the projectile push and revolve the projectile out of the rifled section of the cartridge. Immediately after the projectile leaves rifled section, the grooves on its surface become open to the expanding gases, which are ducted in them, providing strong lateral support over all grooved area. The front cylindrical portion of the projectile, having a sliding fit with the bore, insures the gases from escaping and decreasing the pressure. The gases in the grooves and the sliding fitted annular space provide a gas lubrication effect as well as enduring effect on the projectile walls during entire phase of acceleration after leaving the cartridge. Those effects of gas lubrication and lateral support make possible to avoid dry friction, hit generation and to increase the ratio between the masses of the payload and the structure of the projectile.

The presented heretofore aspect of the invention is convenient solution for small, medium and comparably high caliber systems or for automatic fire of the small and medium caliber arms. There is no any technological complication's using the present invention. Manufacturing a smooth bore barrel is substantially easier compare to conventional rifling. Manufacturing the ammunition round includes the same main procedures regularly applied for small and medium caliber rounds involving rolling tools particularly shaped.

During the first phase of interior ballistic, the defined short rifled section of the cartridge is exposed to high temperature and friction instead of the corresponding part of the main barrel, therefore preventing it from erosion. During the second phase-acceleration, the friction between the barrel walls and the projectile's outer surface is minimal, the projectile uses all the pressure force for acceleration to higher level, therefore minimizing erosion of the barrel. The improved efficiency of the propellant could be used different ways:

- To increase the muzzle velocity and the range of the fire. (The range increases with square of the muzzle velocity improving the effectiveness of the weapon);
- To increase the total mass of the projectile at the same velocity;
- To decrease the total mass of the propellant used for acceleration of the same mass of the projectile keeping previously established ballistic properties;
- To have a combination of all of the above-mentioned benefits aiming to achieve higher efficiency of the weapon system-more rounds with longer range per same weight at sufficiently higher barrel fife.

The use of the first aspect of the present invention has technical consequences which influent the entire system. The short rifled bore barrel, part of the cartridge case, is exposed not only to thermal, thermo-chemical and mechanical erosion, but also to the revolving recoil impulse-torque. Part of this revolving impulse-torque is transferred by friction of slightly expanded cartridge neck (short rifled barrel) directly to the walls of the breech Another part of the torque is transferred by the structure of the cartridge to its rear wall, which has means to engage the breech part of the weapon. The rear part of the cartridge has a star-shaped wreath of small trangle prisms or flukes, which are engaged congruently with the opposite breechblock part, shaped the same way. The main axial recoil impulse is pressing hardly on the rear pattern, preventing the cartridge case from twisting. To receive sufficient revolving impulse at the very beginning of acceleration, the slope or pitch of the rifling must be more severe. The more severe rifling can lead to reinforcement of the short rifled part of the cartridge and its walls therefore to increase the weight of the cartridge, especially for medium and bigger caliber weapon.

Different approach is used to avoid the cartridge reinforcement and to improve further the performance and versatility of the system, resulting in another aspect of the present invention.

The second aspect of the present invention uses different approach to avoid reinforcement of the cartridge walls and to improve further the performance and versatility of the system. It is related to the second distinguished phase of interior ballistic starting in the moment when the projectile leaves the end of the short rifled barrel. According to this aspect, the projectile gains additional revolving impulse traveling down the smooth bore barrel.

At least a couple of substantially opposite longitudinal grooves extends into narrow channels through the non-grooved cylindrical portion of the projectile. This portion is preferably 5 to 10% of the entire cylindrical length. Those narrow channels change its direction to the opposite of the direction of the revolving impulse and gradually enlarge to the front ogival shaped part of the projectile therefore forming jet nozzles within the space secluded between the barrel wall and the channel. The narrow part of the channels forms the throat enlarging to the nozzle. When hot gases ducted into the grove reach the throat and the nozzle they produce an effect of a jet. Each nozzle has to have direction opposite to the revolving impulse. A small portion (0.1 to 5%) of the high-temperature and high-pressured gases goes throughout the groove, throat and leaves the nozzle, providing jet forces and revolving impulse to the projectile.

Depending on the caliber of the projectile, more than one couple of grooves could be transformed to jet nozzles therefore bigger part of the revolving impulse would be generated by jet forces rather than by the short rifled barrel. The proportion between the parts of the revolving impulse gained, according to both aspects of the present invention, depends on the purpose, caliber and other engineering considerations. When the grooves are parallel to the axis, there is no revolving impulse generated according to the first aspect, therefore only the second aspect is to be applied. In this case at least one couple of opposite grooves is necessary to be transformed to jets. For big caliber projectiles the gain of revolving impulse upon the second aspect of the present invention can reach 100% and all grooves can be transferred into jets. As far as all of the grooves, according to first and second aspects of the present invention, are insulated from direct friction with the barrel by dry lubricating layer, groove's bottom surface could be used for identification purposes. Traced shallow lines similar to one used for barcode could be imposed on the bottom of the groove during manufacturing/assembly process. This will allow batch identification and further backtracking of the used ammunition and its linking to the customer /in this case customer ID would be required, The use of the second aspect of the present invention leads to reduction of torque recoil and better lubrication of sliding fitted projectile and barrel surfaces. It is clear to one skilled in the art, that each one of both aspects can be used separately or their effects can be combined together—each one contributing part of the finally gained revolving impulse.

DRAWINGS

Figures

The embodiments of the smooth bore barrel system with self-spinning ammunition in accordance with the present invention will be described herein after with the reference to the accompanying drawings:

FIG. 1 is a cross-section of the breech part of the barrel with inserted and partially cut bottleneck cartridge case and side elevation of the projectile inside the cartridge case.

FIG. 1-A is a cross-section of the cartridge case according to the first aspect of the present invention.

FIG. 1-B is a side elevation of generic projectile according to the first aspect of the present invention.

FIG. 5 is a cross-section of the barrel with inserted, partially cut, thin wall, bottleneck cartridge case with row of blistered moons staying for lands and side elevation of the fitted projectile.

FIG. 5-A is partially cut bottleneck cartridge case with inserted partially telescoped projectile and very short rifled part formed by indentations or teeth at the end of the neck.

FIG. 6 is a cross-section of smooth bore barrel part with side elevation of fitted projectile having grooves extended into jets according to the second aspect of the present invention.

FIG. 6-A is a cross-section of the front portion of the cartridge case with assembled projectile according to the second aspect of the present invention.

FIG. 6-B is a cross-section of the smooth bore barrel with inserted projectile cut through line A—A as shown on FIG. 6.

Figure 7:
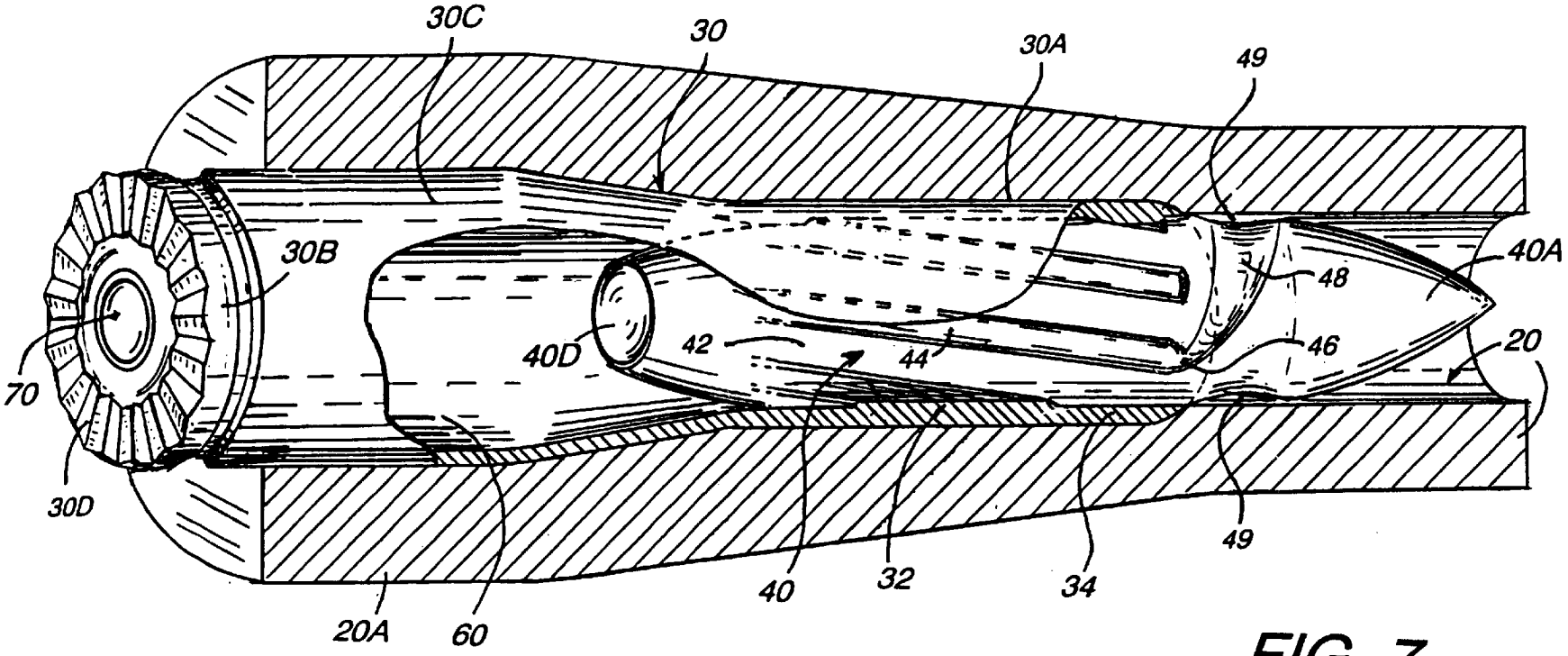

FIG. 7 is a perspective view of the cross-section of the breech part of the barrel with round assembly loaded into the barrel.

Figure 8:
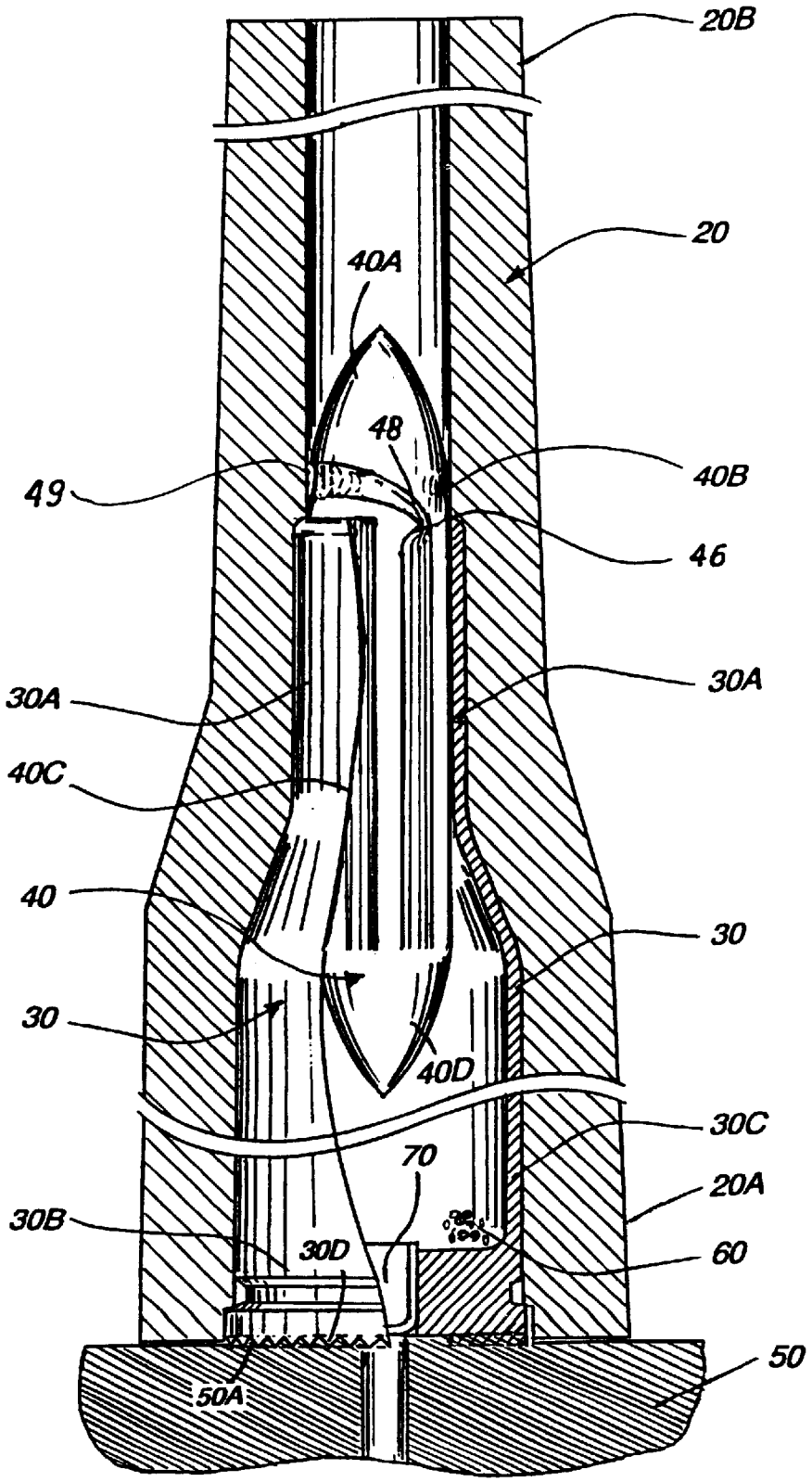

FIG. 8 is a cross-section of the breech part of the barrel with inserted and partially cut cartridge with fitted projectile having jet propulsion nozzles.

Reference Numerals

20. Barrel, smooth bore barrel

20A. Breech end of the barrel—cartridge case nest

20B. Muzzle end of the smooth bore barrel

30. Cartridge case

30A. Rifled section of the cartridge case—short rifled barrel

30B. Rear portion of the cartridge case

30C. Propellant chamber

30D. Flukes covered star-shaped surface of the cartridge rear

32. Lands (ridges) on the rifled section of the cartridge case

34. Grooves on the rifled section of the cartridge case

34A. Rows of blistered moons or indentations forming lands on the rifled section

40. Projectile

40A. Front ogival portion of the projectile

40B. Short front cylindrical portion of the projectile

40C. Long cylindrical grooved (rifled) portion of the projectile

40D. Rear portion of the projectile

42. Lands (ridges) on the cylindrical long portion of the projectile

44. Grooves on the cylindrical long portion of the projectile optionally having the bottom surface marked with thin lines

46. Narrow channel—part of the extended through the short front cylindrical portion groove-throat

48. Enlarging part of the narrow channel forming a jet nozzle

49. Jet chamber formed between the extension of the groove and the wall of the barrel

50. Part of the breech-block.

50A. Flukes covered star-shaped surface of the breech-block

60. Propellant

70. Igniter

DETAILED DESCRIPTION OF THE PREFERRED EMBODIMENTS

First Preferred Embodiment

Figure 1:
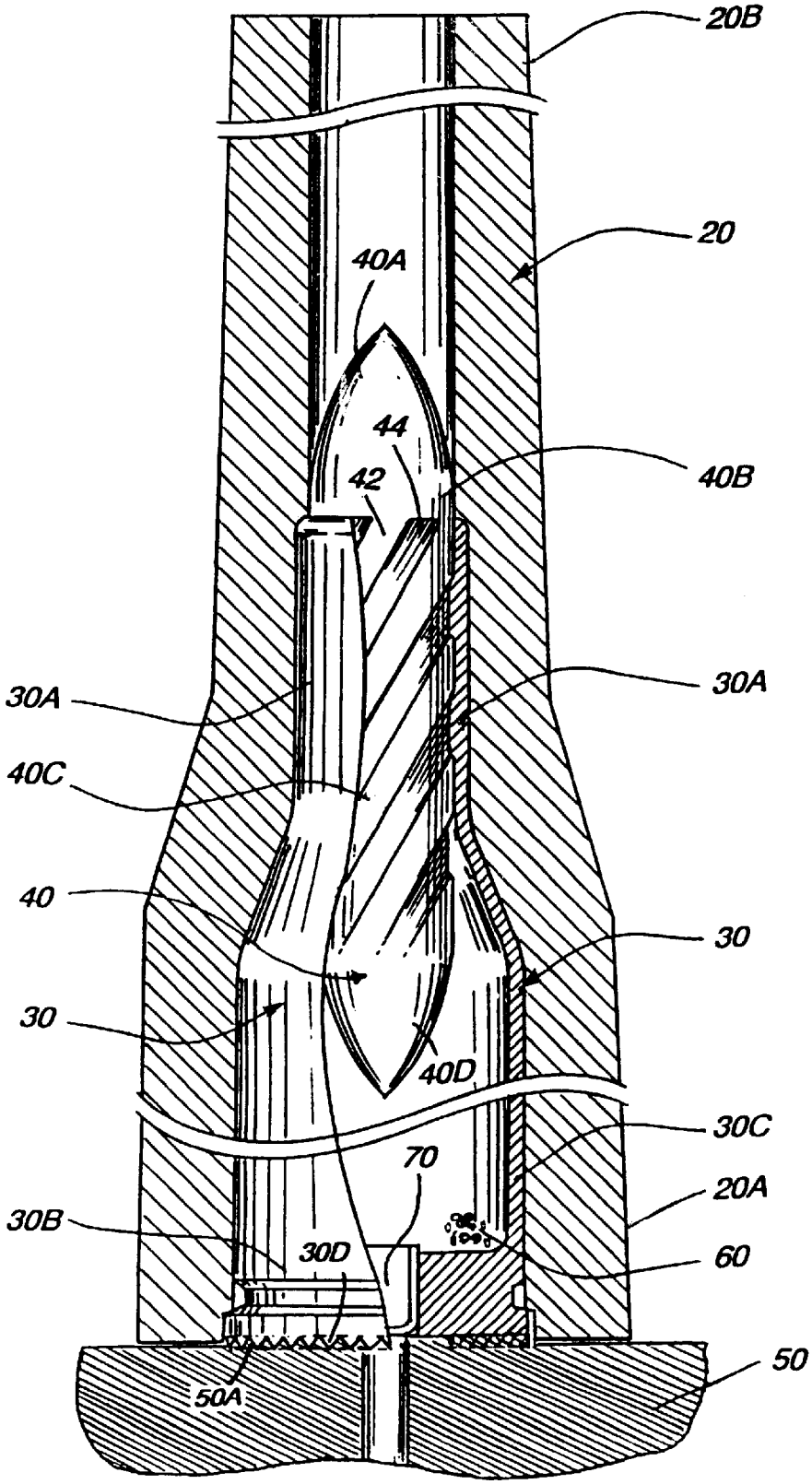

When seen on FIG. 1 the cross section of the cartridge case 30 seats in the nest 20A, which is the breech part of the smooth bore barrel 20 and is closed and supported from its rear bottom part 30B by the breech-block part 50. The cartridge case 30, shown better on FIG. 1-A, that has an elongated section 30A having inside surface rifled with grooves 34 defining lands 32 therebetween. The diameter defined by the rifled grooves 34 is substantially the same as the inner bore of the barrel 20 on FIG. 1. The rifled section 30A has a smooth bottle-neck transition to the propellant chamber 30C which is closed from the rear by the wall section 30B. This rear section has an annular opening where is fitted an igniter 70. The external rear wall 30B has annular ring, which is star-shaped wreath of radially situated flukes surrounding coaxially the igniter 70, better shown on FIG. 2 and discussed further.

The rifled section 30A engages with close but sliding fit the projectile 40, shown on FIG. 1-B. The projectile 40 has one long cylindrical portion 40C which surface is rifled with longitudinally grooves 44 defining lands 42 therebetween. The rifled portion starts from the rear preferably ogival portion of the projectile 40D and ends adjacent to short not rifled portion 40B of the cylindrical part of the projectile. This frontal cylindrical portion 40B smoothly tapered to the front ogival portion of the projectile. The length of the grooved cylindrical portion 40C is preferably 90–95% of the total cylindrical part of the projectile therefore the length of the non-grooved portion 40B is preferably 5–10%. The rifled outer cylindrical portion 40C of the projectile 40, shown separately on FIG. 1-B, is engaged congruently with rifled section 30A of the cartridge 30, shown separately on FIG. 1-A. The front part of the projectile 40, including the ogival tapered nose section 40A and the portion 40B of the projectile, are inserted and fitted with sliding fit into the smooth bore of the barrel 20, shown on FIG. 1

A hard or semi-hard paste with low friction properties, based on molybdenum sulfide or graphite, not shown on the drawings, is used to lubricate both rifled surfaces of contact and to provide watertight seal for the propellant in the propellant chamber 30C. The rear section 30B of the cartridge case 30 has a concentric ring of radial star-shaped triangle prisms or flukes 30D coaxial to the igniter 70 situated centrally on the rear wall. This concentric ring has its flutes engaged congruently with a wreath of the same type of flukes covering surface on the breech-block 50.

Operation of the First Preferred Embodiment

As shown on FIG. 1 etc. when fired, the propellant 60 is developing in very short time high temperature and high pressure gases, which are pushing the projectile 40 forward into the smooth bore barrel 20. The rifled bore barrel section 30A of the cartridge 30 is revolving the projectile 40 by the means of the fitted rifled surfaces on 30A and 40C. The axial velocity of the projectile increases from zero to some medium value and the projectile is developing its full spin during the initial acceleration along rifled bore barrel section.

When the breech load is fired, the projectile 40 receives an axial impulse towards the ballistic trajectory. The same impulse with the opposite direction receives the cartridge case 30 and transfers this impulse through the breech to the entire weapon as a recoil impulse. The recoil impulse is reversely proportional to the accelerated mass, which is the mass of the weapon. During the acceleration down the rifled section 30A, the projectile 40 receives its full revolving impulse. The same revolving impulse with the opposite direction receives the cartridge 30 and this impulse acts as a torque to the cartridge. To transfer this torque to the entire mass of the weapon and not to allow the cartridge to rotate around its axes, the bottom of the cartridge 30 is designed with means to engage the breech-block and this way to transfer the torque. It is preferred in this embodiment to have the rear section 30B of the cartridge 30 covered with star-shaped triangle prisms or flukes 30D, shown better on FIG. 2.

When the breech-block closes the bridge, the flukes 30D are congruently engaged to the same type of surface 50A on the closing part of the breech 50 on FIG. 1. As the axial recoil impulse pressurizes the cartridge case 30 to the breech 50, the revolving impulse-torque is easily transferred by engaged surfaces 30D and 50A to the breech and thus to the entire mass of the weapon. Part of the torque is transferred to the mass of the weapon by the friction of the walls of the cartridge, temporarily expanded by the high pressurized gases, with the walls of the breech nest 20 A.

In a conventional rifled barrel weapon, there is always bi-directional recoil with tendency to twist the weapon along the barrel axes, especially when fired automatically. As for as the direction of the revolving impulse depends on the direction of the grooves, a line of "left" and "right" spinning cartridges can be easily arranged in the magazine or the belt for machine gun weapons, to reduce or eliminate the revolving part of the recoil impulses.

Figure 2:
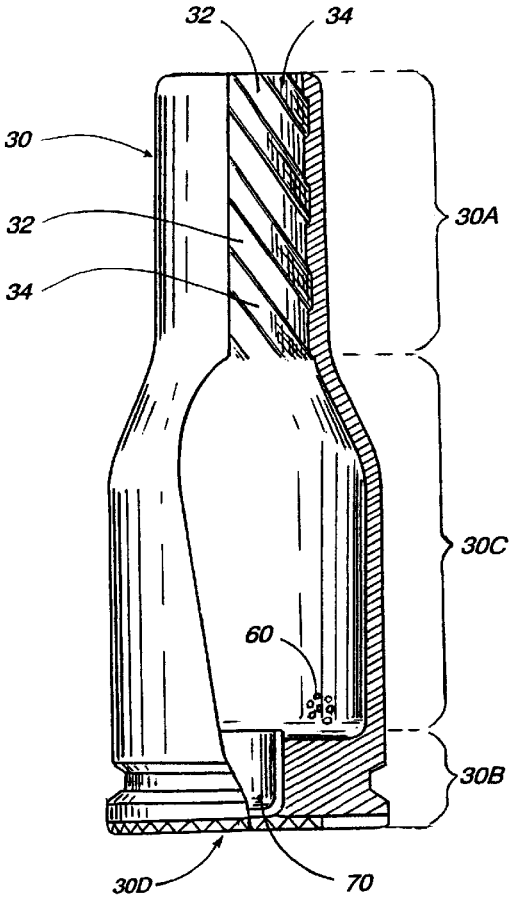
FIG. 2 is a perspective view from the rear of the cartridge case.
Figure 2:
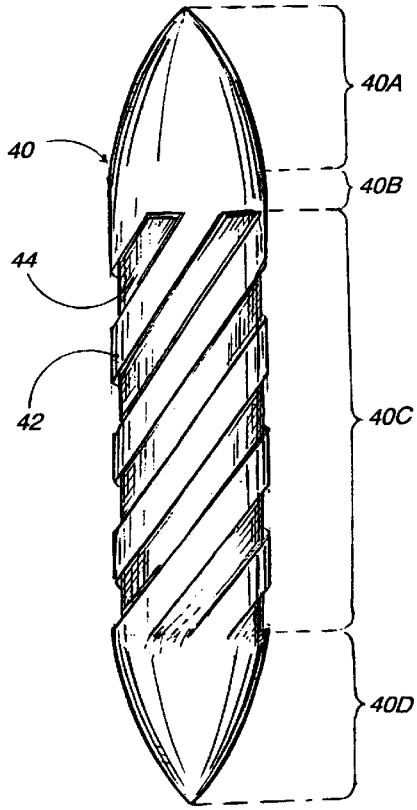
Figure 2:
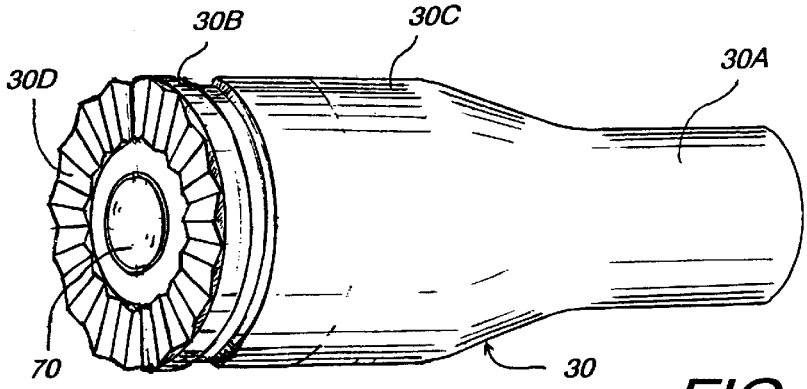

The embodiment shown on FIG. 1 and FIG. 2 represents a conventional "bottle neck" concept of cartridge having the diameter of the cartridge case 30 substantially larger than the diameter of the. "bottle neck" 30A, which in this embodiment serves as a short rifled barrel. The "bottle neck" concept has technological advantage in manufacturing where the material used to fabricate propellant chamber 30C is pressed and rolled to smaller diameter of the rifled barrel 30A forming lands and grooves. The means of ignition 70 and propellant 60 are not different from those of conventionally used. The rear portion 40D of the projectile 40 facing the breech preferably has ogival shape and extends deeper into the propellant chamber 30C. The purpose of this ogival shape is to provide better distribution of the fast expanding propellant gases into the grooves 44 during the interior ballistic and to complete the projectile streamline during the exterior ballistic therefore contributing positively for the longest range. The rear section 40D could be shaped also conventionally upon some constructive considerations, especially in ammunition for small arms as shown on FIG. 5-A and FIG. 7. The grooves 44 may have their bottom surface marked with fine longitudinal lines in consequence similar to those on the barcode. This lined surface can be linked to and represent particular batch number as far as it is permanent and doesn't change by wall friction.

On FIG. 2 is shown the pattern with the flukes 30D on the rear section 30B of the cartridge 30. The radially directed flukes are forming concentric ring around the igniter surface 70. The flukes 30D are engaged congruently by the same type of flukes 50A on the surface of the breech-block 50 shown on FIG. 1.

Additional Variant of First Preferred Embodiment

Figure 3:
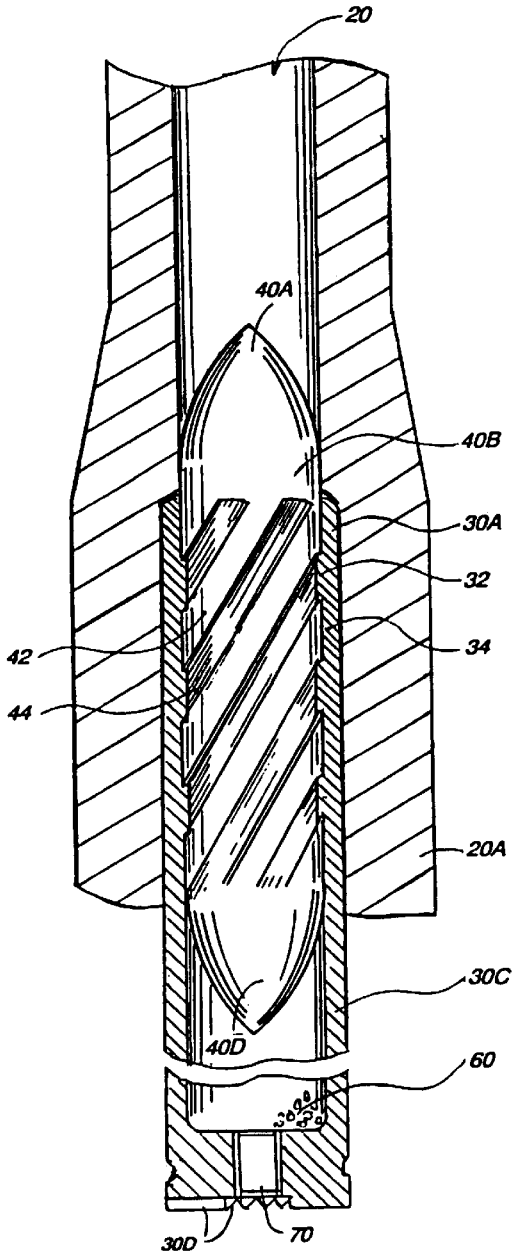
FIG. 3 is a cross-section of the barrel with inserted partially cut cylindrically shaped cartridge case.

Another preferred embodiment shown on FIG. 3 depicts the cartridge case 30 having the main inner diameter of the propellant chamber 30C substantially close to the diameter of the grooved section 30A. The diameter of the grooved section 30A is substantially close to this of the bore of the barrel 20. The diameter of the congruently engaged lands 42 of the projectile as well as the diameter of the non-grooved front cylindrical part 40B is substantially the same, with a little negative tolerance insuring sliding fit with the diameter of the smooth bore barrel. The entire cartridge case 30 has a slightly conically tapered surface with tolerances accepted as normal in any conventional cartridge of similar type for easier discharge. This embodiment is convenient for small arms, automatic weapons and sportive guns.

Second Preferred Embodiment

Figure 4:
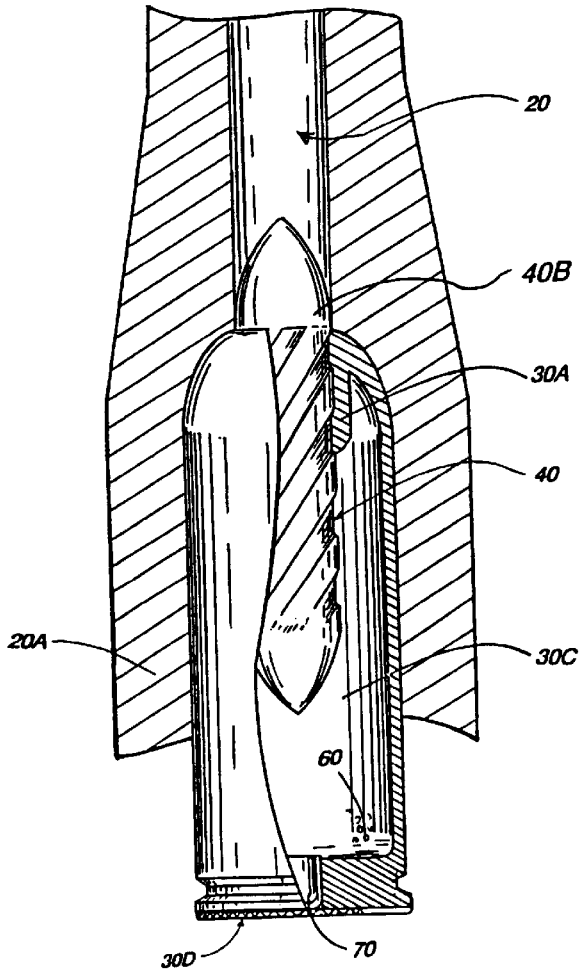
FIG. 4 is a cross-section of the barrel and side elevation of the inserted partially telescoped cartridge case with congruently fitted projectile.

The preferred embodiment shown on FIG. 4 represent yet another disclosure, which pertain to the ammunition type usually referred as telescoped. The principal difference with already discussed embodiments on FIG. 1 and FIG. 2 is that the rifled section 30A of the cartridge case 30 is inverted into the propellant chamber 30C and surrounded with propellant 60. This change results into shorter ammunition round with compact shape, more convenient for automatic weapons.

Operation of Second Preferred Embodiment

When fired, the propellant 60 develops high pressure over the comparably thin rifled section 30A thereby providing full lateral support to this section during the first phase of acceleration of the projectile. The grooved part of the projectile 40 is engaged in the rifled section 30A and only non-grooved cylindrical portion 40B of the projectile is extended into the smooth bore barrel 20. This embodiment has a significant advantage when shorter total length is necessary. Inward reversed short rifled section 30A practically has no mechanical enlargement upon the pressure of the propellant gases and this way avoids mechanical interaction between the outer surface of the short rifled barrel and the surrounding part of the smooth barrel 20.

Third Preferred Embodiment

FIG. 5 represents another embodiment with bottleneck close to this on FIG. 1 but with shorter rifled section 30A The lands of the inner part of the cartridge case 30, compare to first and second embodiments, are replaced by rows of blistered moons 34A fitted into the grooves 44 of the projectile and sealed with lubricant. The high of the blisters is equal or slightly bigger than the correspondent high of the lands in conventional rifled barrel. The lubricant fills completely the space surrounding blisters 34A in the grooves 44. The moving forward projectile 40 is very well lubricated during the first phase of acceleration After leaving the cartridge 30, the projectile has its grooves 44 open and immediately filled by the hot high-temperature gases, which provides lateral support to the projectile walls and gas lubrication along the barrel 20. Manufacturing ammunition upon presented embodiment is technologically easy and inexpensive. The use of blisters instead of fully shaped lands allows a thinner cartridge material to be used without loss of mechanical properties.

Additional Variant of Third Preferred Embodiment

FIG. 5-A shows another embodiment of the present invention where the rifled section 30A is reduced by length to only short ruling indentations 34A on the inner surface of this section, which are engaged in the grooves 44 of the projectile. The projectile 40 has its grooved portion 40C entirely telescoped into the propellant chamber 30C. Moving forward the projectile slides its grooves along the indentations 34A and spins around its axis. This embodiment is convenient for small caliber rounds, providing the projectile with speed little over or less than 1 M (sound velocity).

Fourth Preferred Embodiment

Another preferred embodiment completely representing the first and the second aspects of the present invention is shown on FIG. 6, FIG. 6-A FIG. 6-B, FIG. 7 and FIG. 8. One or more couples of the opposite grooves 44 on the surface of the projectile 40 tapered to narrow channels 46. Those channels change its direction from one parallel to the general axis of the projectile 40 and barrel 20 to direction opposite of the revolving impulse. The narrow channels 46 gradually tapered to wider channels 48 serving as nozzles. The nozzles 48 and barrel wall 20 form jet-chambers 49. The nozzles 48 in the preferred embodiment shown on FIG. 6-A are enclosed into the neck portion 30A of the cartridge 30.

Operation of Fourth Preferred Embodiment

When the propellant 60 is fired, the projectile 40 moves forward receiving revolving impulse during the first phase of acceleration as explained heretofore. After leaving the case 30 the hot gases fill immediately grooves 44 and through the narrow throat 46 get expanded into nozzles 48 which are forming jet chambers 49 with barrel wall 20, shown on FIG. 6. The couple or more of opposite jet chambers creates jet forces directed to spin the projectile around its axis. Part of those forces is inclined toward the direction of acceleration of the projectile, but the resultant forces are those revolving the projectile. As far as a small amount of the total energy developed by the propellant –0.15 to 0.5% is engaged to create revolving impulse, the amount of energy lost, as part of dragging force toward the moving projectile, is insufficient. The developed jet forces are proportional to the velocity and the mass of the gas flow through the jets. If at least one couple opposite grooves are acting as jets, a couple of jet forces are revolving the projectile around its main axis. It has to be emphasized that the couple of jet forces will revolve the projectile even in case where the grooves are parallel to the main axis and no spin is generated during the first phase of acceleration. Therefore both of the described heretofore aspects of the present invention will provide the projectile 40 with spin independently or by mutual interaction. The contribution of each aspect to the finally gained revolving impulse depends upon engineering consideration coming with the purpose and a caliber of the weapon and ammunition. The quantity of the gases used to rotate the projectile is proportional but always much less comparing to that necessary to produce the same revolving impulse by engraving, dragging and dry friction along the barrel. A big advantage of the second aspect of the present invention shown in this embodiment is the significant drop of the revolving part of the total recoil impulse. This drop is directly proportional to the part of the revolving impulse gained by pairs of jet forces. In the embodiment shown on FIG. 8 the grooves are parallel to the main barrel and projectile axis, and couples of jet forces are the only source of revolving impulse. In this embodiment there will not be any revolving part of the recoil impulse, therefore not any torque at all.

FIG. 6-B depicts one preferred shape of the groves 44 and lends 42 tending to distribute better the hot gases around the projectile therefore to provide better gas lubrication.

In FIGS. 1, 3, 4, 6, 7 and 8 depicting assembly of the system upon present invention is clearly shown that the cartridge case nest 20A in the breech part of the barrel 20 has always bigger diameter compare to the smooth bore. The smooth bore portion of the barrel 20 begins from the end of the nest 20A.

Conclusions

The present invention provides extremely important features concerning technology of the manufacturing of the weapon—smooth bore barrel is much easier to manufacture with great accuracy and precision, compare to rifled bore. The ammunition is manufactured using same equipment with slightly different tooling. There is no process of manufacturing in-situ (pressing and engraving in the weapon's barrel), which is one of the main drawbacks of the rifled barrel weapon.

The following features show many advantages of using the system upon the present invention:

- The dry friction along the barrel is completely exchanged by gas lubrication and semidry lubrication therefore eliminating heat generation and fast barrel wearing;
- The total amount of the propellant is used for acceleration of the projectile and automatic recharge of the weapon;
- The muzzle velocity is higher which results in significantly longer range, because the range is proportional to the square of the muzzle velocity;
- The ratio payload/structural mass is considerably improved, based on high pressure gas lateral support and use of thinner projectile walls;
- The total weight of the ammunition necessary for the same mission is greatly reduced;
- The self-spinning ammunition in combination with compact telescoped shape is exceptionally convenient for automatic weapons;
- The recoil impulse is reduced significantly and twisting component of the recoil impulse could be totally eliminated;
- There is easy way to mark the batch number on the projectile of the ammunition, therefore to backtrack the ammunition to the weapon and the user if necessary.
- As far as the objective of the present invention is to provide variety of barrel-type weapons, which have means to rotate and stabilize the projectile in flight, the shown preferred embodiments serve as highly effective alternative to many types contemporary weapons.

What we claim is:

1. A projectile round (40) in combination with a gun barrel and a breech block comprising, the gun barrel having a smooth tubular central bore (20) defining a muzzle end (20B) and a breech end (20A), said breech end including a breech block (50) and said breech block containing a front surface with ridged flukes disposed on said front surface (50A), said projectile round comprising a cartridge case (30), said cartridge case comprising an open front surface (30A) and a closed rear surface with ridged flukes disposed on the outside of said closed rear surface (30D), and a forward portion of a smaller diameter which tapers to a rearward portion (30B) of a larger diameter, said ridged flukes of said closed rear surface of said cartridge case are adapted to congruently fit said ridged flukes of said breech block when said projectile round is loaded in said breech end of said gun barrel, said rearward portion containing a propellant chamber (30C) and said forward portion containing a rifled inside surface (30A) defining corresponding lands (32) and grooves (34), said projectile round further comprising a projectile (40) disposed in said cartridge case, said projectile having ogival shaped front (40A) and rear (40D) portions with short cylindrical portion (40B) connected adjacent to said ogival shaped front portion and a long cylindrical portion (40C) disposed adjacent to said short cylindrical portion, said short cylindrical portion and long cylindrical portion having substantially the same diameter as an inner diameter of said forward portion of said cartridge case, said long cylindrical portion comprising a rifled outer surface with corresponding lands (42) and grooves (44) disposed along the length of said long cylindrical portion to engage the lands and grooves of said rifled inner surface of said forward portion of said cartridge case in a congruent fit when said projectile is mounted into said cartridge case with said rear portion of said projectile disposed inside said propellant chamber of said rearward portion of said cartridge case and said short cylindrical portion adjacent the said front ogival portion of said projectile extending outside of said front portion of said cartridge case and into said gun barrel when said projectile round is loaded into said gun barrel with the outside diameter of the short cylindrical portion adjacent the front of said projectile being slightly smaller than the inner diameter of said gun barrel to provide a sliding fit, whereby upon igniting a propellant (60) in said propellant chamber of said cartridge case, a rotational motion is imparted along the lands and grooves of said projectile in response to the propellant charge as said projectile travels along the lands and grooves of said inner portion of said forward portion of said cartridge case and exits said forward portion of said cartridge case and enters the gun barrel with said cartridge case being secured by said congruent fit of said ridged flukes on said breech block and said rearward portion of said cartridge case, against rotational motion.

2. A gun barrel projectile round and breech-block system as set in claim 1, where the diameter of said rifled neck section of said cartridge case is substantially smaller than the diameter of said propellant chamber therefore said neck forms a bottle-neck shaped cartridge whereby to facilitate manufacturing by rolling said cartridge case from cylindrical material of a bigger diameter.

3. A gun barrel projectile round and breech-block system as set in claim 1, where said rifled neck portion of the said cartridge case has a substantially smaller diameter compared to the inner diameter of said propellant chamber and said rifled neck section is inverted into said propellant chamber forming an annular space around said rifled neck and said rifled section of said cylindrical portion of said projectile is engaged congruently by sliding fit with said rifled neck section of the said cartridge and said projectile having said relatively short non rifled cylindrical portion extended into said smooth bore barrel, said annular space is designed to provide strong support around said short rifled section by the high pressure gases, whereby to allow the length of the round to be shortened substantially and be convenient for high speed automatic weapons.

4. A projectile round as set forth in an 1 of claims 1–3 where the pitch of the said rifled neck section of said cartridge and said rifled cylindrical portion of said projectile have more severe activity compared to a normally striated barrel of a conventional weapon, whereby to impart substantial spinning momentum at low initial velocity of the projectile.

5. A projectile round as set forth in claim 1 where said engaged grooves and lands of the said neck and said projectile are water/gas sealed by dry, semidry or paste-like lubricant.

6. A projectile round as set forth in claim 1 where said lands on the said neck section of said cartridge case are formed as rows of blistered indentures (34A) having a width substantially equal to a width of the congruently engaged grooves on said cylindrical portion of the said projectile and the space between said row of blistered indentures and said grooves on said cylindrical portion of said project is filled and sealed with said dry or semidry lubricant.

7. A gun barrel projectile round and breech-block system as set forth in claim 1 where said rear portion of the said projectile is extended into said propellant chamber tapering from a cylindrical to a conical or an ogival shape.

8. A projectile round (40) in combination with a gun barrel and a breech block comprising, the gun barrel having a smooth tubular central bore (20) defining a muzzle end (20B) and a breech end (20A), said breech end including a breech block (50), said breech block containing a front surface with ridged flukes disposed on said front surface (50A), said projectile round is loaded in said breech end and secured to said breech block against rotational motion, said projectile round comprising a cartridge case (30) and a projectile (40) with said projectile mounted in said cartridge case, said cartridge case comprising an open front surface (30A) and a closed rear surface (30B) with ridged flukes (30D) disposed on the outside of said closed rear surface, and a forward cylindrical portion of a smaller diameter which tapers to a rearward cylindrical portion of a larger diameter, said ridged flukes of said closed rear surface of said cartridge case are adapted to congruently fit said ridged flukes of said breech block when said projectile round is loaded in said breech end of said gun barrel, said rearward cylindrical portion forming a propellant chamber (30C), said projectile comprising ogival shaped front (40A) and rear portions (40D) with short cylindrical portion (40B) connected adjacent to said ogival shaped portion and a long cylindrical portion (40C) disposed adjacent to said short cylindrical portion, said short cylindrical portion and said long cylindrical portion having substantially the same diameter as said rifled inner surface of said front portion of said cartridge case, said long cylindrical portion having lands (42) and grooves (44) along an outside diameter which are disposed in a different direction than said lands and grooves of said short cylindrical portion, said grooves of said long cylindrical portion taper down to a smaller diameter at the end adjacent the front end of said projectile to form narrow channels (46), said narrow channels connected to channels of a larger diameter (48) disposed substantially perpendicular to said narrow channels and located on said outer diameter of said front end of said projectile, whereby after igniting a propellant (60) inside said propellant chamber, a rotational motion is imparted on said projectile as said projectile travels through said gun barrel, as high compressed gases flows along said grooves of said long cylindrical portion into said narrow channel and then is forced out through the larger channels developing jet forces spinning said projectile, with said cartridge case being secured by said congruent fit of said ridged flukes on said breech block and said rearward portion of said cartridge case against rotational motion, said grooves of said long cylindrical portion taper down to a smaller diameter at the end adjacent the front end of said projectile to form narrow channels (46), said narrow channels connected to channels of a larger diameter (48) disposed substantially perpendicular to said narrow channels and located on said outer diameter of said front end of said projectile, whereby after igniting a propellant (60) inside said propellant chamber, a rotational motion is imparted on said projectile as said projectile travels through said gun barrel, as high compressed gases flow along said grooves of said long cylindrical portion into said narrow channel and then is forced out through the larger channels developing jet forces spinning said projectile, with said cartridge case being secured by said congruent fit of said ridged flukes on said breech block and said rearward portion of said cartridge case, against rotational motion.

9. A projectile as set in claim 8 where all groves and lands are parallel to the main axes of said projectile and said barrel.

10. A projectile as set in claim 8 where all grooves and lands are helical around the main axes of said projectile and said barrel.

11. A projectile as set forth in claims 1 or 8 where said grooves of said projectile have their bottom surface marked with thin longitudinal lines in a predetermined consequence pertaining to and representing the identification of said projectile.

* * * * *